US005769009A

United States Patent [19]

Saitoh

[11] Patent Number: 5,769,009

[45] Date of Patent: Jun. 23, 1998

[54] METHOD OF DISPOSING OF COMBUSTION RESIDUE AND AN APPARATUS THEREFOR

[76] Inventor: Shigeru Saitoh, 169, Dai, Obamamachi, Iwaki-shi Fukushima 974, Japan

[21] Appl. No.: 500,867

[22] PCT Filed: Nov. 15, 1994

[86] PCT No.: PCT/JP94/01926

§ 371 Date: Jul. 17, 1995

§ 102(e) Date: Jul. 17, 1995

[87] PCT Pub. No.: WO95/14194

PCT Pub. Date: May 26, 1995

[30] Foreign Application Priority Data

Nov. 17, 1993 [JP] Japan ..... 5-309647
Mar. 25, 1994 [JP] Japan ..... 6-077879

[51] Int. Cl.[6] ..... F23G 5/00

[52] U.S. Cl. ..... 110/259; 110/165 R; 110/266; 110/257

[58] Field of Search ..... 110/118, 165 A, 110/165 R, 344, 236, 245, 259, 266, 257

[56] References Cited

U.S. PATENT DOCUMENTS 3,302,598 2/1967 Godel ..... 110/165 R
3,861,331 1/1975 Saitoh et al. ..... 110/257
4,991,519 2/1991 Saitoh ..... 110/259 X
5,078,065 1/1992 Tsunemi et al. ..... 110/165 R X
5,191,844 3/1993 Scheel ..... 110/236 X

FOREIGN PATENT DOCUMENTS 4-15404 1/1992 Japan .
4-177015 6/1992 Japan .
4-250876 9/1992 Japan .

*Primary Examiner*—Henry A. Bennett
*Assistant Examiner*—Susanne C. Tinker
*Attorney, Agent, or Firm*—Flynn, Thiel, Boutell & Tanis, P.C.

[57] ABSTRACT

A hearth particle bed incineration furnace is used to remove dioxin contained in a combustion residue through the mixing of the hearth particle bed particles and the combustion residue at a temperature of at least 400° C., preferably from 400°–600° C., for at least 30 minutes, preferably 30 minutes to 2 hours, through the adjustment of the rate of removal of the mixture. An incineration furnace is provided which can be compact and yet have a large capacity and a stable operation over a long period of time.

4 Claims, 7 Drawing Sheets

METHOD OF DISPOSING OF COMBUSTION RESIDUE AND AN APPARATUS THEREFOR

FIELD OF THE INVENTION

The present invention is directed to a method of removing dioxin from a combustion residue and an apparatus for performing the method.

BACKGROUND OF THE INVENTION

Although there are many known processes for removing dioxin from a combustion gas, there is no known industrial method for removing dioxin from a combustion residue generated in a hearth particle bed incinerating furnace of the type disclosed in Japanese Patent Laid-Open Hei 4-15404 (JP A 92-15404).

SUMMARY OF THE INVENTION

It is an object of the present invention to provide an industrially suitable method and apparatus for removing dioxin from the combustion residue produced in a hearth particle bed incinerating furnace.

It is a further object of the present invention to provide a hearth particle bed incinerating furnace which generates a combustion residue containing reduced amounts of dioxin and possesses a combustion chamber having a wall of a continuous slope which detains the substance to be incinerated.

These and other objects of the present invention are accomplished by providing a method for treating a combustion residue in which a mixture of a combustion residue and hearth particles are maintained at a temperature of 400° C. or higher for at least 30 minutes in an incinerating furnace to remove dioxin from the combustion residue.

The present invention is also directed to a method of treating a combustion residue in which a combustion gas having a temperature of at least 400° C. is supplied to a mixture of a combustion residue and hearth particles for at least 30 minutes to remove dioxin from the combustion residue.

A further aspect of the present invention is directed to a hearth particle bed incinerating furnace comprising a combustion chamber having an inclined surface on which a hearth particle bed is disposed, means for introducing hearth particles onto the inclined surface, air inlets provided at a second inclined surface for promoting incineration of a waste material, a fan for extracting combustion gas from the combustion chamber at a lower position of a hearth particle bed and supplying the high temperature combustion gas to a mixture of hearth particles and combustion residue at a temperature of at least 400° C. and a removal means provided beneath and separate from the extraction point of the combustion gas for removing the mixture of the combustion residue and hearth particles and controlling the residence time of the mixture in the combustion chamber to at least 30 minutes.

In another aspect of the present invention, the removal means comprises a first conveyor means which receives a mixture of the hearth particles and the combustion residue having an angle of repose on the first conveyor means equal to that of the hearth particles and a second conveyor means which receives hearth particles containing substantially no combustion residue, wherein each conveyor is operated independently of each other.

In a still further aspect of the present invention, the removal means comprises two parallel conveyor means which partially overlap, with one conveyor means being separated from the outlet of the combustion chamber and receiving the mixture of the hearth particles and combustion residue falling from a front half area of the outlet and carrying it laterally to a receiving tank and a second conveyor means is disposed separate from the outlet and receives hearth particles containing substantially no combustion residue exiting from the other half area of the outlet and carries it laterally in a different direction.

DESCRIPTION OF THE PREFERRED EMBODIMENTS

The incineration furnace of the present invention is particularly suitable for the destruction of wastes containing dioxin. The dioxin is effectively removed from combustion residue remaining from the incineration of the waste material by heating a mixture of the combustion residue and hearth particles at a temperature of at least 400° C., preferably between 400°–600° C., for at least 30 minutes, preferably 30 minutes to 2 hours.

DESCRIPTION OF THE PREFERRED EMBODIMENTS

Figure 1:
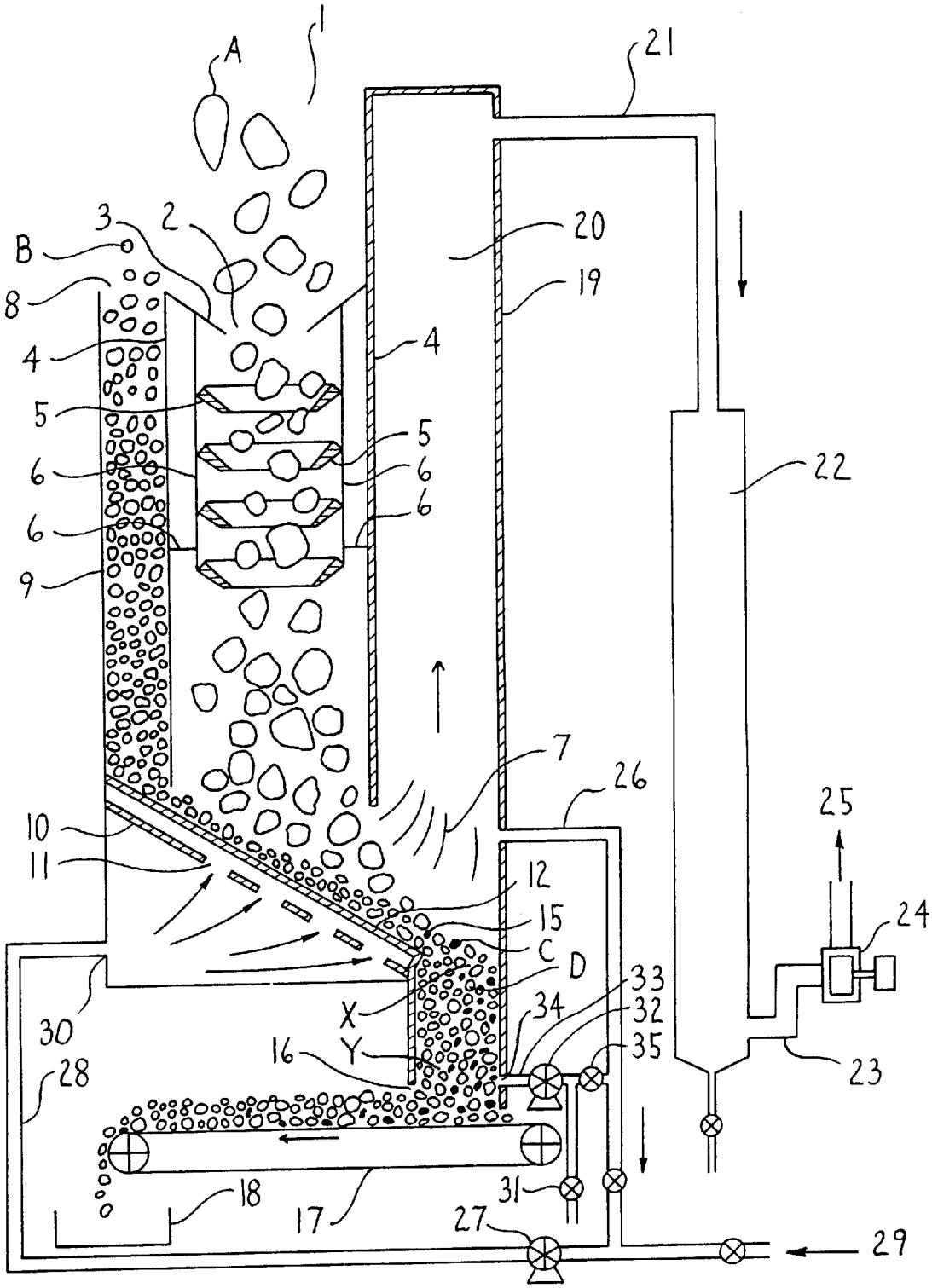
FIG. 1 is a partial cross-sectional view of an incinerating furnace containing a hearth particle bed according to the present invention.

As illustrated in FIG. 1, the hearth particle incinerating furnace of the present invention comprises an inlet 1 through which burning materials A are introduced into a hopper 3 of the furnace. The opening 2 of the hopper 3 decreases as it extends into the furnace to avoid contact of the furnace sidewalls 4 with the burning material. Alternatively, annular baffles having a central opening which decreases as they extend along the length of the hopper 3 can be contained in the hopper in order to direct the flow of the burning material A toward the center of the hopper. Portions of the sidewall 4 exposed to high temperatures should preferably be covered by a fireproof material and a lower portion of the sidewall 4 makes up a part of the incineration chamber 7.

Hearth particles B are introduced into the furnace at an inlet 8 adjacent to the inlet 1 for the burning materials A. The hearth particles B fall along a chamber formed between the sidewall 4 and an outer sidewall 9 into contact with an inclined channel member 12.

Figure 2:
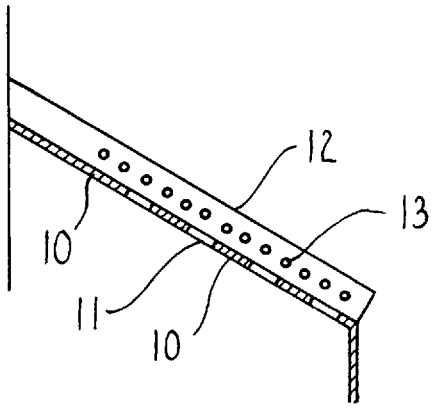
FIG. 2 is a partial sectional view illustrating the arrangement of air inlet apertures on a channel member of the present invention.
Figure 3:
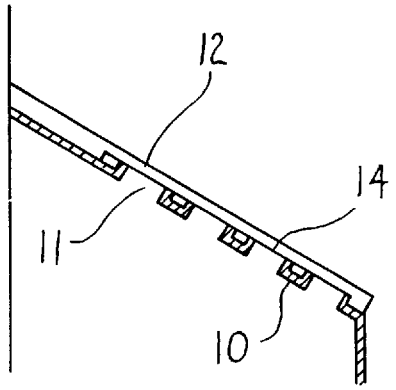
FIG. 3 is a partial sectional view of a channel member according to the present invention.

As shown in FIG. 2, the channel member 12 is provided with an upper bight portion and two downwardly extending leg portions. A lower plate member 10 is provided underneath the channel member 12 and is inclined at an angle preferably about equal to that of the angle of repose of the hearth particles B. A plurality of air inlet apertures 11 are provided in the lower plate member 10 for promoting the combustion of the materials to be burned A.

The legs of the channel members 12 have a plurality of air outlet apertures 13 or slits provided in their sides and maintain the upper bight surface a fixed distance from the plate member 10. The upper bight portion of the channel member 12 is inclined at an angle approximately parallel to that of the plate member 10 and serves as a second inclined surface upon which a layer of hearth particles flow into the incineration chamber 7. The upper surface of the bight portion of the channel 12 contains no apertures therein and is flat.

The hearth particles B form a hearth particle bed layer 15 and flow downwardly on the upper surface of the channel member 12. The channel members 12 preferably do not have open upper ends or, if they do, the upper ends of the channel members 12 are closed to aid in the flow of the hearth particles. Additionally, the ends of the channel members 12 are also closed to prevent air leakage.

The hearth particles B that can be used in the present invention can be any type of particles, such as natural crushed mineral stone, coarse sand and iron particles, that are sufficiently durable under high temperature conditions and form sufficient gaps therebetween for air to flow between the hearth particle to the combustion chamber when they are contained therein as a hearth particle bed 15. A suitable mean particle diameter of the hearth particles is greater than 5 mm, preferably from about 1 cm to about 20 cm, and more preferably, from about 2 cm to about 10 cm.

The hearth particles B forming the hearth particle bed layer 15 sequentially move by gravity continuously or intermittently along the top surface of the channel member 12 without being fluidized and, due to the top surface of the channel member 12 being inclined at an angle approximately equal to the angle of repose of the hearth particles B, the layered shape of the hearth particle bed layer 12 does not change. The angle of repose of the hearth particles B can readily be determined by one of ordinary skill in the art depending on the characteristics of the materials and the shape and the diameter of the particles and the angle of inclination of the channel member 12 and the plate member 10 can be adjusted accordingly.

Figure 4:
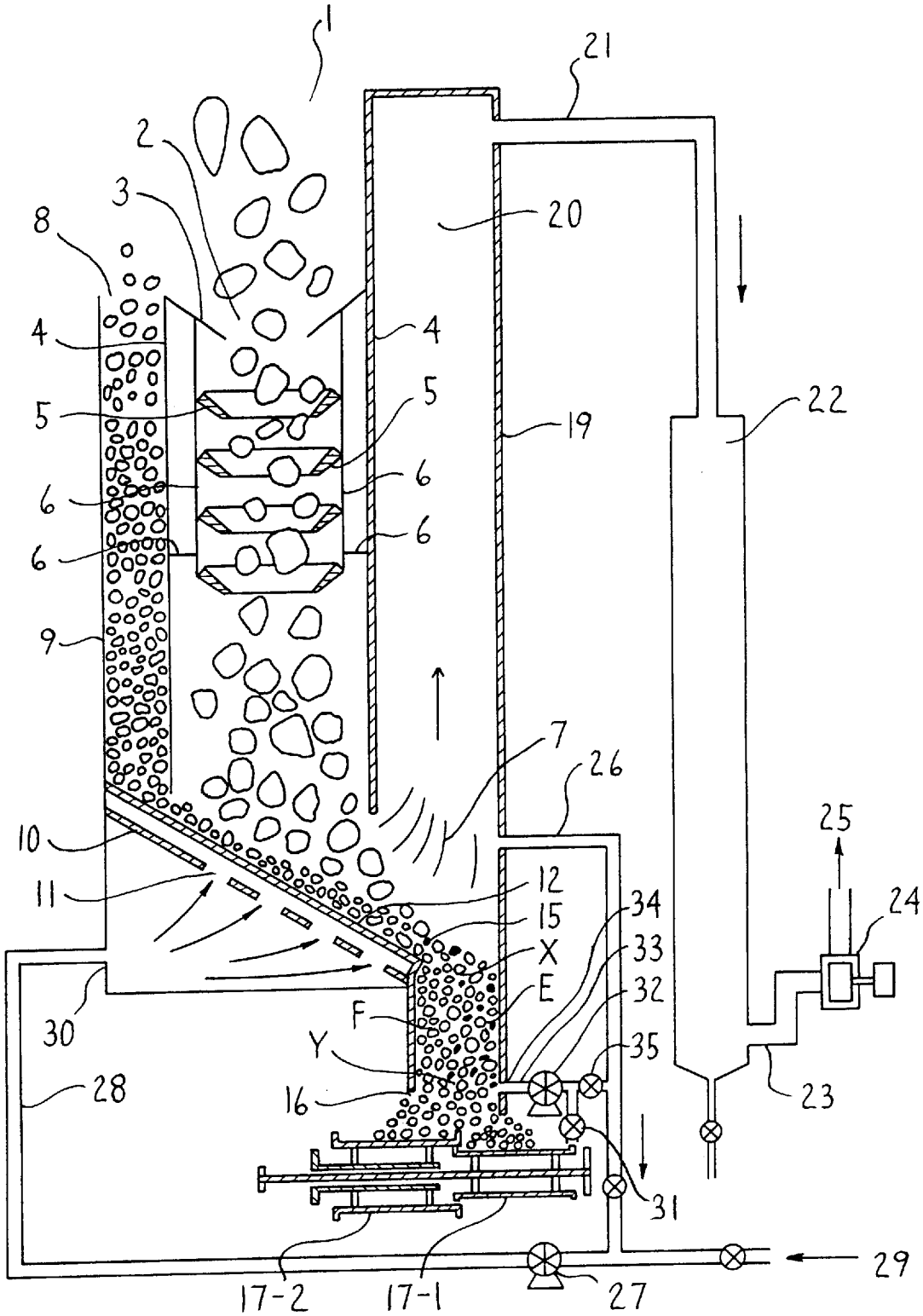
FIG. 4 is a partial sectional view of a hearth particle bed incinerating furnace according to the present invention illustrating the arrangement of the first and second conveyors.
Figure 5:
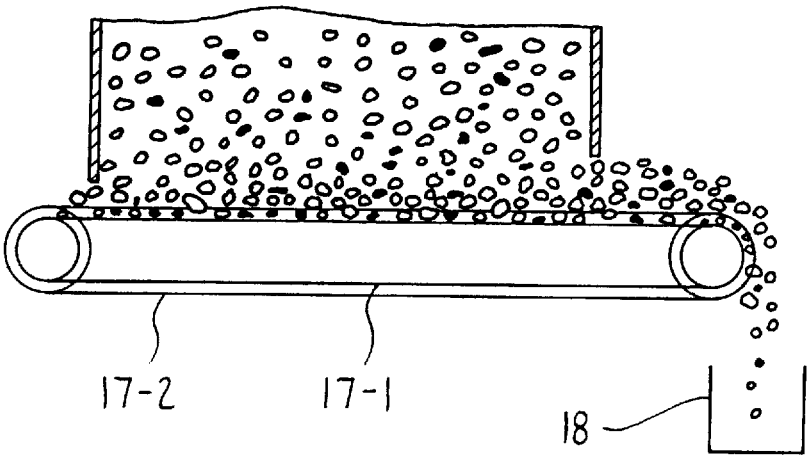
FIG. 5 is a partial cross-sectional view illustrating the relationship between an outlet from the incinerating chamber and the conveyors of FIG. 4.
Figure 6:
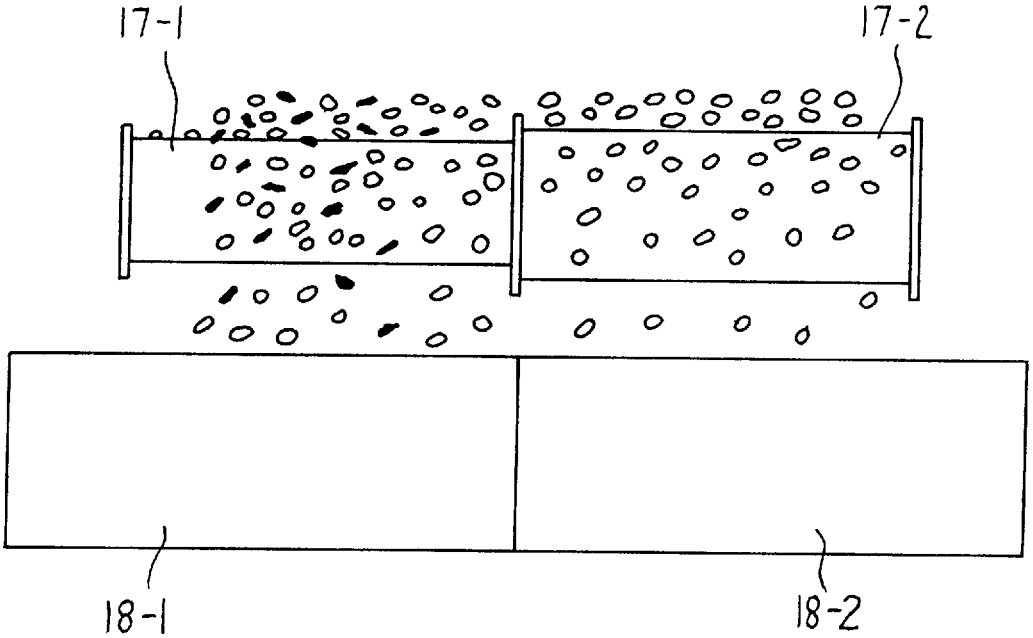
FIG. 6 is a view illustrating the conveyors emptying into receiving tanks.

In the present invention, the incineration or combustion chamber 7 is an area comprising a lower portion of sidewall member 4, a lower portion of wall 9 and the plate member 10. The air inlets 11 are provided in the plate member 10 for promoting burning of the material A. The air inlet 11 may be an aperture with, as shown in FIGS. 1 and 4, the channel member 12 provided above the aperture 11. The edges of the opening of the apertures 11 preferably extend upwardly in order to prevent small hearth bed particles from falling through. The air blown upwardly through the inlet 11 has its directional flow changed and is introduced into the hearth particle bed 12 through a plurality of apertures 13 or slits 14 provided in the channel member 12.

The diameter of the air inlets 11 may be comparatively large, for instance, from about 3 cm to about 10 cm but smaller than the diameter of the hearth particles to prevent them from getting stuck therein and are preferably from about 3 mm to 4 cm in diameter. The diameter of the apertures 13 provided in the channel member 12 are smaller than that of the hearth particles B in order to prevent them from dropping into the apertures 13. As is illustrated in FIG. 2, there are a plurality of apertures 13 provided in the channel member 12 and they typically have a diameter of from about 5 mm to about 2 cm. The width of the slit 14 may be about the same size as the apertures 13 and the length of the slit 14 is not critical as long as it does not weaken the channel member 12 itself. That is, all that is required is that the slit 14 be shorter than the channel member 12 with the number and position of the slits not being restricted.

In the furnace, the materials A incinerate and form a small amount of combustion residues C which mix with hearth particles B and become a combustion mixture D. The combustion mixture D exits the furnace via outlet 16 and onto a conveyor means 17 for removing the combustion mixture 16 from the furnace. Although a conveyor belt 17 is illustrated as the means for removing the combustion mixture, other mechanisms such as rotary gears, diaphragms and rotary cylinders can be used also.

As illustrated in FIG. 1, when a conveyor belt 17 is used as the means for removing the combustion mixture D, the combustion mixture D exits the outlet 16 of the furnace and falls onto the surface of the conveyor belt 17. The outlet 16 is formed such that the combustion mixture D deposits on the conveyor belt 17 at an angle approximately equal to the angle of repose of the hearth particles B. Due to this design, the combustion mixture D removed from the outlet 16 does not spread over the area defined by the angle of rest of the mixture D and the distance between the outlet 16 and the conveyor belt 17. As such, the combustion mixture D will not unexpectedly spread over the conveyor belt and spill if the conveyor belt is designed to have a certain area larger than the area required by the angle of repose and the distance between the conveyor belt 17 and the outlet 16. Moreover, the distance between the outlet 16 and the conveyor belt 17 can be changed if so desired.

Once the combustion mixture D is deposited on the conveyor belt 17, it is transported to a collection box 18 at the discharge end of the conveyor belt. After being deposited in the collection box 18, the combustion residue C can be separated from the combustion mixture D and the hearth particles separated and recycled back into the furnace.

The waste gas of combustion produced by the incineration of material A travels up along wall 19, which is covered by a fireproof material, and passes through a heat exchanger member 20, an exhaust pipe 21, a cooling and washing tower 22, a ventilating fan inlet 23, a ventilating fan 24 and is discharged through a chimney 25. As shown in FIGS. 1 and 4, a portion of the high temperature waste gas is removed through duct 26 by blower 32 and injected into the mixture of hearth particles and combustion residue at a lower portion of the combustion chamber 7. The high temperature waste gas is used to help maintain the temperature of the mixture of hearth bed particles and combustion residue at a temperature of at least 400° C. to aid in the decomposition of dioxin that may be present in the combustion residue.

A part of the high temperature waste gas of combustion chamber 7 removed through duct 26 can be passed through circulation fan 27 and duct 28, mixed in a predetermined ratio with fresh air at room temperature and introduced through the air inlets 11 and the air apertures 13, 14 of the channel members 12 to incinerate the materials to be burned 8.

The shape of the hearth bed and the hearth bed furnace of the present invention is not critical and can be cylindrical, rectangular, quadrilateral or any other shape. Additionally, the horizontal cross-sectional shape of the inlet 1 can be of any hollow shape which allows incinerating materials to fall therein by gravity, such as a circle, an oval, a rectangle, etc.

The hopper 3 is fixed to the inlet 1 of the furnace by angle joints 6, 6 so that it does not come into direct contact with sidewall members 4. As discussed previously, the diameter of the central aperture of the hopper 3 preferably decreases as the hopper extends into the furnace but the diameter should be large enough not to obstruct the entry of incinerating materials into the furnace. The angle of entry into the hopper 3 may be so large that incinerating materials can slide down therein smoothly and yet prevent the waste gas from flowing upstream through cooperation with the baffle 5. That is, the angle of the hopper 3 may be preferably from 10° to 80° C., more preferably from 20° to 70°, with respect to the sidewall of the inlet.

The baffles 5 are located near the upper part of the inlet 1 into which the incinerated materials are introduced, as shown in FIG. 1, and is preferably a cylindrical member which increases in diameter as it extends upwardly. That is, the diameter of the baffle 5 decreases as it extends downwardly. If a plurality of baffles are used, they are preferably located a specific distance from each other. The diameter of the central aperture of the baffle 5 is preferably the same as that of the hopper 3 and the outer edge of the hopper is spaced from the sidewall a distance small enough to allow a space for the waste gas to flow upstream therein. The baffle 5 is preferably angled at an amount equivalent to that of the hopper 3. However, the angle of the baffle 5 may be different from that of the hopper 3. Additionally, if possible, the baffles 5 may be fixed to the wall of the incineration furnace by angle joints strong enough to bear the physical shock caused by contact with falling incinerating materials.

As shown in FIGS. 4–12, the removal means 17 can be made up of two separate removal members 17-1 and 17-2. If the substrate to the incinerator is an organic material, the bulk density of the combustion residue is relatively small so that the combustion residue remains on the surface of the hearth particles as they move out of the outlet 16 of the furnace.

The mixture of the particle hearth bed material and the combustion residue moves obliquely downward on channel member 12, moves down along the side wall 19 and then is taken away from the front side area of the outlet 16. The combustion residue and the hearth particles are in a partially mixed state, so the mixture is taken out from the front half part of the outlet 16 and the hearth particles containing substantially no combustion residue is taken out from the opposite side area of the outlet 16.

The invention is further explained when a caterpillar conveyor or a belt conveyor is adopted as the removal means. As indicated in FIG. 4 to FIG. 9, a first conveyor means 17-1 and a second conveyor means 17-2 are disposed below the outlet 16 at right angles to the flow direction of the hearth particles and combustion residue. Each conveyor means receives half of the falling hearth particles. Between the outlet 16 and the two conveyor means 17-1, 17-2, the mixture of the hearth particles and the combustion residue forms a bed with an angle of repose of the hearth particles.

The mixture of the hearth particles and the combustion residue removed from the outlet 16 is divided into two parts, one containing the combustion residue, shown front side (E side in FIG. 4), is carried by the conveyor means 17-1 to receiving tank 18-1, the other containing substantially no combustion residue is carried by the conveyor means 17-2, shown in FIG. 4 in rear side (E side in FIG. 4), to the receiving tank of 18-2. Each conveyor means is operated independently and the velocity of the conveyor operation is adjustable. The velocity ratio of the two conveyors is in general 1:10 to 10:1, more preferably 1:5 to 5:1.

Figure 7:
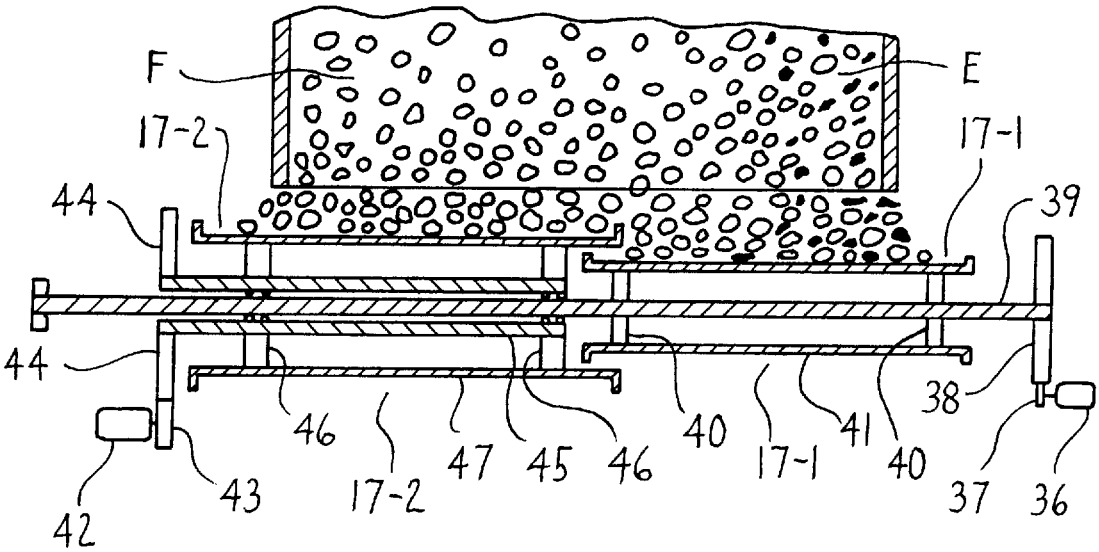
FIG. 7 is a cross-sectional elevation view of the combustion chamber outlet and the conveyors illustrated in FIG. 4.
Figure 8:
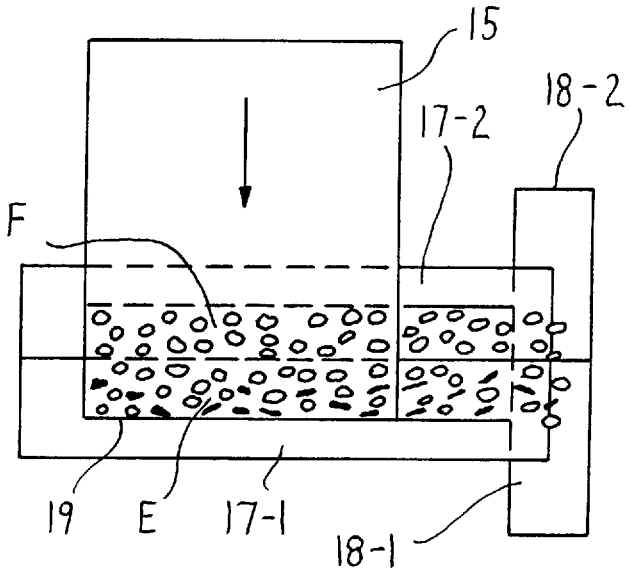
FIG. 8 is an upper side view of the incineration chamber outlet and conveyors illustrated in FIG. 4.
Figure 9:
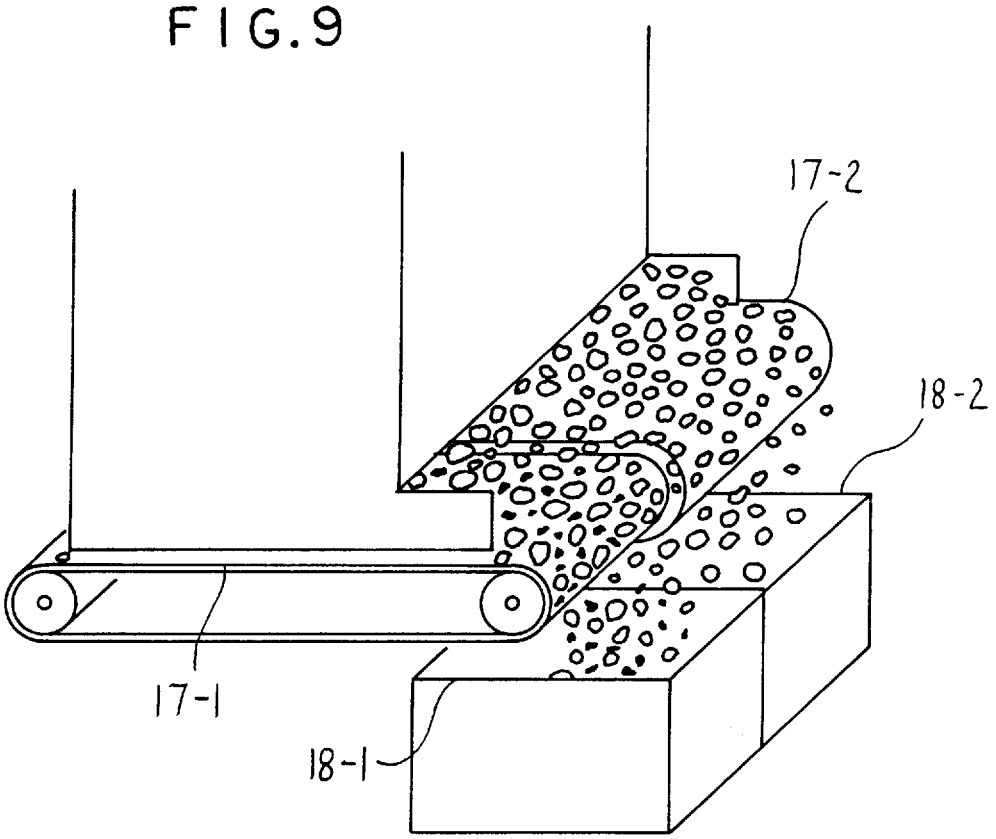
FIG. 9 is a top view of the incineration chamber outlet and conveyors illustrated in FIG. 4.

An example of the invention is shown in FIG. 7, in which the first conveyor assembly 17-1, comprising a conveyor 41 which is driven by a motor 36, a transmission gear 37, 38, a shaft 39, and a sprocket 40. The second conveyor is operated the same as the first conveyor and driven by a motor 42, a shaft 39, and a sprocket 40. The second conveyor assembly 17-2 comprises a conveyor 47 which is operated the same as the first conveyor by transmission gear 43, 44, a sleeve 45 and a sprocket 46.

The hearth particles containing the combustion residue is taken out by the front first conveyor 17-1 and dumped into the receiving tank 18-1. Hearth particles in the receiving tank are separated by a sieve from the combustion residue and recycled again as hearth bed particles. The rear conveyor 17-2 carries the hearth particles containing substantially no combustion residue into the receiving tank 18-2 where they are recycled as hearth bed particles without any treatment, but a separation process from the combustion residue may be performed if desired.

If the second conveyor 17-2 is operated rather fast, the hearth particle bed moves downward rapidly and, therefore, combustion in the chamber 7 is accelerated.

The conveyor assembly 17-1, 17-2 should be made of fire proof materials which are durable at temperatures of 400°–600° C., for a period of 30 minutes to 2 hours. A caterpillar or belt conveyor made of steel or fire resistant material is preferable.

Figure 10:
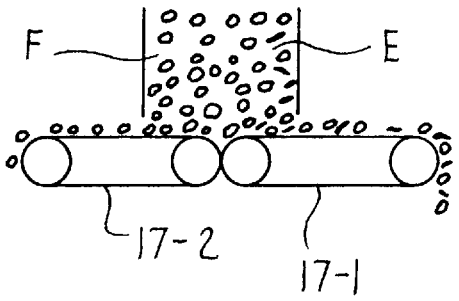
FIG. 10 illustrates an embodiment on the present invention in which the conveyors move in opposite directions.
Figure 11:
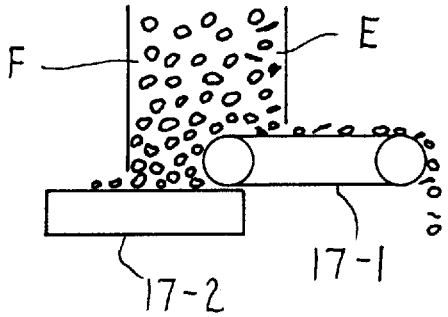
FIG. 11 illustrates an embodiment of the present invention in which the first conveyor moves in the same direction as the flow direction of the hearth particle bed from the incinerating chamber and the second conveyor moves at a right angle to the flow of the hearth particle bed.
Figure 12:
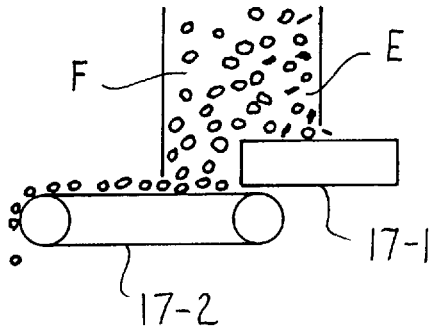
FIG. 12 illustrates an embodiment of the present invention in which the first conveyor is disposed perpendicular to the flow of the hearth particle bed and the second conveyor moves in the opposite direction of the flow of the hearth particle bed.

Other embodiments are shown in FIG. 10 to FIG. 12. In FIG. 10, the first conveyor 17-1 is disposed along the flow direction and the second conveyor 17-2 carries the hearth particles in the opposite direction. In FIG. 11, the first conveyor 17-1 carries the hearth particles in the same direction as the flow direction and the second conveyor 17-2 moves at right angles thereto and in FIG. 12, the first conveyor 17-1 moves at right angles to the flow direction and the second conveyor 17-2 moves in the opposite direction to the flow.

OPERATION OF THE INVENTION

The operation of the particle incinerating furnaces of the present invention is as follows. Hearth particles B are continuously or intermittently introduced into the furnace through inlet 8 and fall by gravity in the space formed by sidewall 9 and sidewall 4 until they contact with the upper surface of channel member 12 where they form a hearth particle bed layer 15 which flows along the upper surface of the channel member 12. Incinerating materials A are fed into the furnace through inlet 1 where they fall through a hopper 3 and are directed toward the center of the hopper by baffles 5 contained therein. The incinerating material A falls through the hopper 3 and into the combustion chamber 7 into contact with the hearth particle bed layer 15 flowing down the channel member 12. The baffles 5 aid in the prevention of waste gas flowing upstream.

The air used in incinerating the materials A is generally supplied from the inlet 1 to the furnace. However, supplemental air for incineration is provided by mixing the high temperature waste gas from the incineration and fresh air and is introduced into the combustion chamber through air inlets 11 provided in a plate member 10. The supplemental air flows through the air inlets 11 and into contact with the channel members 12 where the air flow is redistributed by flowing through apertures 13, 14 provided in legs of the channel 12. The air finally flows through the spaces provided between the particles forming the hearth particle bed layer 15 and into the combustion chamber 7 to promote the burning of the materials A therein. The combustion residues C mix with the hearth particles B and exit from the furnace via outlet 16 and are deposited on a removal means such as the conveyor belt 17 illustrated in FIG. 1. The outlet 16 is shaped so that the mixture of combustion residue C and hearth particles B are deposited on the conveyor belt 17 at an angle equal to the angle of repose of the hearth particles B. As such, if the movement of the conveyor belt 17 stops, the discharge of the material out of the outlet 16 also stops. The conveyor belt carries the mixture of hearth particles B and combustion residue C to a container 18 where the hearth particles can be separated from the combustion residue and reused in the furnace.

The waste gas of combustion travels up along wall 19, through a heat exchanger member 20, an exhaust pipe 21 and into a cooling and washing tower 22. The gas is then sent through an exhaust pipe 23, a ventilating fan 24 and out of chimney 25. A portion of the high temperature waste gas from the combustion chamber is removed by blower 32 and injected into the mixture of the hearth particles and combustion residue at a lower part of chamber 7. A part of the waste combustion gas can be sent through a duct 26, circulation fan 27 and a duct 28 where it is mixed with fresh air from the air inlet 29 and blown through air inlets 11 to promote burning of the materials A.

As the combustion proceeds in the combustion chamber 7, and the removal means 17 continuously or periodically carries the mixture D of hearth particles and combustion residue to the end point X of the hearth bed, then the mixture descends, reaches the point Y near the outlet 16 and is taken out from the outlet 16. A part of the exhaust gas is extracted through the conduit 26, which is sent from air inlets 34 disposed near the point Y at the lower part of the hearth bed, at a temperature of 400°–600° C., preferably 450°–550° C., via temperature adjusting valve 31, blow fan 32, and conduit 33.

The reason why the exhaust gas temperature is controlled at the described range is as follows: If the heat treatment temperature is under 400° C., dioxin will not be decomposed by the heat and, on the other hand, if the temperature is higher than 600° C., low melting materials in the combustion residue, such as soft glasses, will melt and may interrupt the taking out the combustion residue.

The time period of the heat treatment is at least 30 minutes because if the time is shorter than 30 minutes, the dioxin is not completely decomposed but if the time is longer than 2 hours, further decomposition is not obtained.

The aforementioned sending of the exhaust gas upward through the flow of the mixture of hearth particles and combustion residue D heats up the mixture to about 400°–600° C., preferably between 450°–550° C. Then the exhaust gas reaches the exhaust conduit or chimney 25 and is extracted by a blow fan 24 and the dioxin contained in the combustion residue is remarkably reduced and the heat treated mixture of hearth particles and combustion residue D is taken out from the outlet 16.

EXAMPLE 1

The incinerating furnace illustrated of FIG. 1 to FIG. 2 was used to incinerate waste plastics for medical use. Crushed stones of serpentine, produced in Chichibu area of Saitama Prefecture Japan, having a mean diameter of 5 cm were used as hearth particles and waste plastics including used injectors made of chlorine containing high molecular weight plastics were crushed and incinerated in the furnace.

The area of the furnace bed was 0.1 square meter (0.2m× 0.5m) and a mixture of the combustion gas and fresh air of approximately 300° C. was supplied during the incineration. The number of air inlets 13 located in the channels 12 were 78 in total and the shape of the holes were a circle having a diameter of 1 cm. The amount of the air flow was 100 L/min/hole. No change was found after a month long continuous operation.

The retention time of the mixture of hearth particles and the combustion residue between the point X and Y was adjusted to be 1 hour by controlling the running speed of the first conveyor to achieve the determined retention time. The exhaust gas having a temperature of 500° C. was introduced from the exhaust gas inlet 34 at a rate of 500 L/hour. The dioxin content of the combustion residue at the position described (X) was 20 ppb and the dioxin content at the position of (Y) was undetectable. That is, the remaining dioxin was completely decomposed and removed so the combustion residue was not harmful.

In contrast thereto, when the exhaust gas was not introduced from the exhaust gas inlet 34, the dioxin content at position (X) was 20 ppb and at position (&) was 15 ppb, so there was no practical difference between the two positions. That is, no removal of dioxin took place.

EXAMPLE 2

An incinerating furnace illustrated in FIG. 4 to FIG. 9 and in FIG. 2 was used to incinerate waste plastics for medical use like Example 1.

A caterpillar conveyor was adopted as a removal means driven as illustrated in FIG. 4. The retention time of the mixture of hearth particles and combustion residue was also adjusted to be 1 hour and the running speed of the first conveyor was controlled to achieve the desired retention time. An exhaust gas of 500° C. was introduced from the exhaust gas inlet 34 at a rate of 500 L/hr.

Substrates to be incinerated were put into the furnace at a rate of 60 Kg/hr and the speed of the second conveyor was so controlled to achieve the movement of the oblique layered hearth particle bed at a rate of 0.1 m/min. The ratio of combustion residue to substrates to be incinerated was 5% and the dioxin content at the position of (X) in the combustion residue was 20 ppb and the dioxin content at position of (Y) was undetectable.

What we claim is:

1. A hearth particle bed furnace system comprising an inclined surface having an angle of inclination such that hearth particles flowing down said inclined surface form a hearth particle bed having a slope equal to the angle of repose of the hearth particles; means for introducing hearth particles onto said inclined surface; a layer of hearth particles flowing down said inclined surface; air inlet means for promoting burning of a material to be burned; a combustion chamber for exhausting combustion gases; a first fan for removing a part of the combustion gases from the combustion chamber and injecting the removed combustion gases into a mixture of the hearth particles and a combustion residue to maintain the temperature of the mixture at at least 400° C.; a second fan for exhausting the remainder of the combustion gases from the furnace system; an outlet means through which the mixture of hearth particles and combustion residue exits the combustion chamber; and removal means for controlling the rate of removal of said mixture from said combustion chamber so that said mixture has a residence time in said combustion chamber of at least 30 minutes.

2. The hearth particle bed furnace system of claim 1, where said removal means comprises a first conveyor means for receiving the mixture of hearth particles and combustion residue such that said mixture rests on said first conveyor means at an angle of repose equal to that of the hearth particles and a second conveyor means for receiving the hearth particles such that the hearth particles rest on the second conveyor means at their angle of repose, said first and second conveyor means operating independently of each other.

3. The hearth particle bed furnace system of claim 2, wherein said first conveyor means receives said mixture from a first half area of said outlet means and transports it laterally in a first direction to a receiving tank and said second conveyor means is provided separate from the outlet means and receives the hearth particles from the other half area of said outlet means and transports the hearth particles laterally in a direction that is different from the first direction.

4. The hearth particle bed furnace system of claim 1, wherein said inclined surface is an upper bight portion of an inverted channel member having downwardly extending leg portions with a plurality of air outlet openings provided therein and said air inlet means are provided in a second inclined surface provided underneath said inclined surface and covered by said channel member.

* * * * *